United States Patent [19]

Meister

[11] Patent Number: 4,506,137

[45] Date of Patent: Mar. 19, 1985

[54] TEMPERATURE RESPONSIVE CONTROL CIRCUIT FOR ELECTRIC WINDOW DE-FOGGER/DEICER HEATER

[76] Inventor: Jack B. Meister, 68 Chimney Ridge, Convent Station, N.J. 07961

[21] Appl. No.: 467,923

[22] Filed: Feb. 18, 1983

[51] Int. Cl.[3] ..... H05B 1/02; E06B 7/12

[52] U.S. Cl. ..... 219/203; 52/171; 219/499; 219/501; 219/505; 219/522; 219/547

[58] Field of Search ..... 219/203, 522, 547, 499, 219/504, 505, 501; 52/171

[56] References Cited

U.S. PATENT DOCUMENTS

| | | | |
|---|---|---|---|
| 2,806,118 | 9/1957 | Peterson | 219/203 |
| 3,114,025 | 12/1963 | Blauvelt et al. | 219/505 X |
| 3,225,173 | 12/1965 | Cook et al. | 219/505 X |
| 3,270,184 | 8/1966 | Negromanti | 219/501 |
| 3,330,942 | 7/1967 | Whitson | 219/203 X |
| 3,360,693 | 12/1967 | Fickweiler | 219/501 X |
| 3,440,521 | 4/1969 | Kessler | 219/203 X |
| 3,446,942 | 5/1969 | Letsinger | 219/203 X |
| 3,902,040 | 8/1975 | Ikeda et al. | 219/203 |
| 3,934,111 | 1/1976 | Roselli et al. | 219/203 |
| 3,973,140 | 8/1976 | Phillips | 219/203 |

FOREIGN PATENT DOCUMENTS

| | | | |
|---|---|---|---|
| 566698 | 9/1975 | Switzerland | 219/522 |
| 1426176 | 2/1976 | United Kingdom | 219/203 |
| 1432862 | 4/1976 | United Kingdom | 219/203 |

*Primary Examiner*—A. Bartis

*Attorney, Agent, or Firm*—Ronald G. Goebel; H. Hume Mathews

[57] ABSTRACT

A control system for regulating the operation of an electric resistance heating grid for de-icing or de-fogging a window of an automobile in accordance with the temperature of the window includes a manually operable switching relay closed by the driver to start the flow of current through the heating grid upon the accumulation of an unacceptable amount of ice or fog on the window. A holding circuit maintains the switching relay closed until such time as an electric resistance-type temperature sensor in heat exchange relationship to the window surface on which the ice or fog accumulates operates through a transistorized circuit to break the holding circuit when the window reaches a preselected temperature high enough to dissipate any fog or ice accumulated thereon. As a safety precaution and to prevent a too heavy a load on the automobile electrical system the control circuit includes an arrangement for automatically opening the holding circuit in the event that the window does not come up to the preselected temperature within a predetermined maximum time period.

2 Claims, 5 Drawing Figures

TEMPERATURE RESPONSIVE CONTROL CIRCUIT FOR ELECTRIC WINDOW DE-FOGGER/DEICER HEATER

BACKGROUND OF THE INVENTION

The invention relates to a control circuit for resistance wire heaters used to de-fog or de-ice windows of automobiles, or other structures.

It is conventional in present day automobiles to provide an electrical resistance grid in or on the rear window of the automobile for heating the glass sufficiently to vaporize fog thereon or to melt ice or snow that may accumulate thereon. Thus fog (extremely small droplets of water that obscure vision through the glass) or ice may be removed sufficiently to restore transparency.

Such electrical resistance heaters are actuated by a timer switch which may be turned on manually when the driver notes that the window has become obscured, and which then automatically turns off after a pre-determined time interval, found by trial and error to be sufficient to allow the heater to vaporize fog or melt that amount of ice that normally may be expected to collect on the window. But such conventional controls, that energize the heater only for a fixed, arbitary time interval, usually "overdo" the job in that the time during which they are turned "on", and are using current from the car battery/alternator, must be greater, than the actual time necessary to vaporize the fog or melt that amount of snow/ice that could be expected to collect on the window under normal conditions. If it were otherwise, instances frequently would occur where the time control would turn the heater off before the de-fogging or de-icing was completed.

Therefore, attempts have been made in the past (see for example U.S. Pat. Nos. 2,006,006; 2,470,633 and 2,507,036) to provide controls for window de-fog or de-ice heaters which are not controlled simply by timers, but by other means. However, none of these attempts have been successful in meeting the needs of the automotive market because the straightforward time control still is used commercially, with resultant waste of current (energy) and with the imposition of unnecessary loads on the battery/alternator system of the vehicle.

BRIEF SUMMARY OF THE INVENTON

According to the present invention, a novel control is provided for regulating the flow of current to the electrical heater of a de-fogger or de-icer unit so that the heater is de-energized as soon as its job is done, i.e. as soon as the unit has de-fogged or de-iced the window on which it is installed.

The control circuit of the invention comprises a sensor in thermal contact with the window to be de-fogged or de-iced, so that the temperature of the sensor will vary as a function of variations in the temperature of the window surface to be de-fogged or de-iced. The sensor itself comprises a resistance element having a high temperature coefficient of resistance, so that the electrical resistance of the sensor varies with the temperature of the sensor. Thus, when the control is turned "on", and current begins to flow through the window heating grid, the temperature of the window will be raised, increasing the temperature of the sensor and also its electrical resistance. The sensor is included in a voltage divider circuit wherein its resistance is balanced against a known fixed resistance of preselected value, selected in accordance with the desired temperature to which the window is to be raised. When resistance of the sensor is raised relative to the fixed resistance, so as to upset the balance between the two, current flows in the control circuit, applying a voltage to a power transistor which reduces the current flow through a holding relay and opens the circuit through which current is fed to the window heating grid.

The window temperature at which the relay opens the circuit is so selected that all moisture that had collected on the window as "fog" will have vaporized by the time the window has reached such temperature and all ice and snow will have been melted and run off the window as a liquid before such window temperature is reached.

As a safety precaution against the possibility that an unusually heavy accumulation of ice and/or snow on the window might require for complete melting too heavy a load on the automobile electrical system (i.e., that the heating grid might have to be on for too long a time before the window will come up to the pre-set control temperature), a time control may also be incorporated if desired in the control circuit, in parallel with the sensor temperature control. This will ensure that the heating grid will not be energized for longer than a predetermined maximum time, in the event the window does not come up to the preselected temperature within that time.

DETAILED DESCRIPTION OF DRAWINGS

Figure 1:
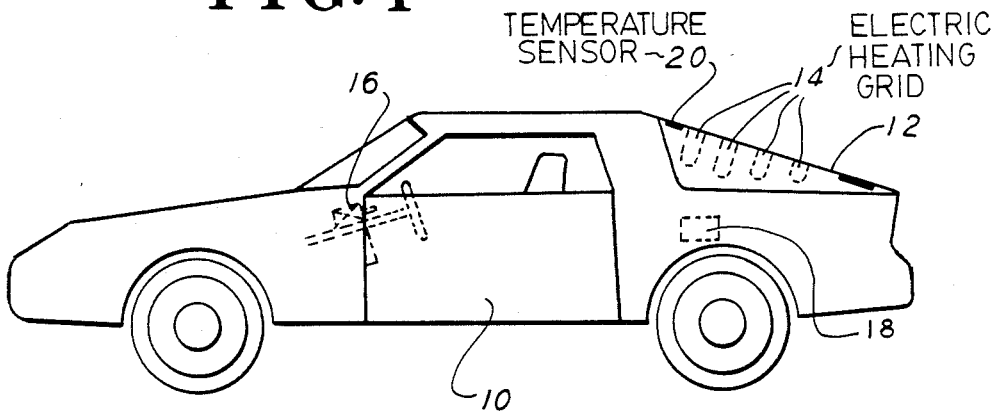
FIG. 1 is a perspective view of an automobile having an electrical heating grid in its rear window and controlled by a manually operated switch on the dashboard and a control circuit located in the trunk compartment, adjacent the rear window.

FIG. 1 shows an automobile 10 having a rear window 12 in which is incorporated a grid 14 of electrical resistance material, constituting an electrical heater for raising the temperature of the glass window to vaporize condensed moisture and to melt ice or snow therefrom. The electric heater is energized by the car's battery and alternator (not shown), which supply electric current to the heater through a manually operated switch 16 on the car's dashboard and an automatically operating control circuit 18, which may be located at the car designer's option anywhere in the car. FIG. 1 shows locations of the switch 16 in the dashboard and the control circuit 18 in the foreward part of the trunk below the rear window.

Figure 2:
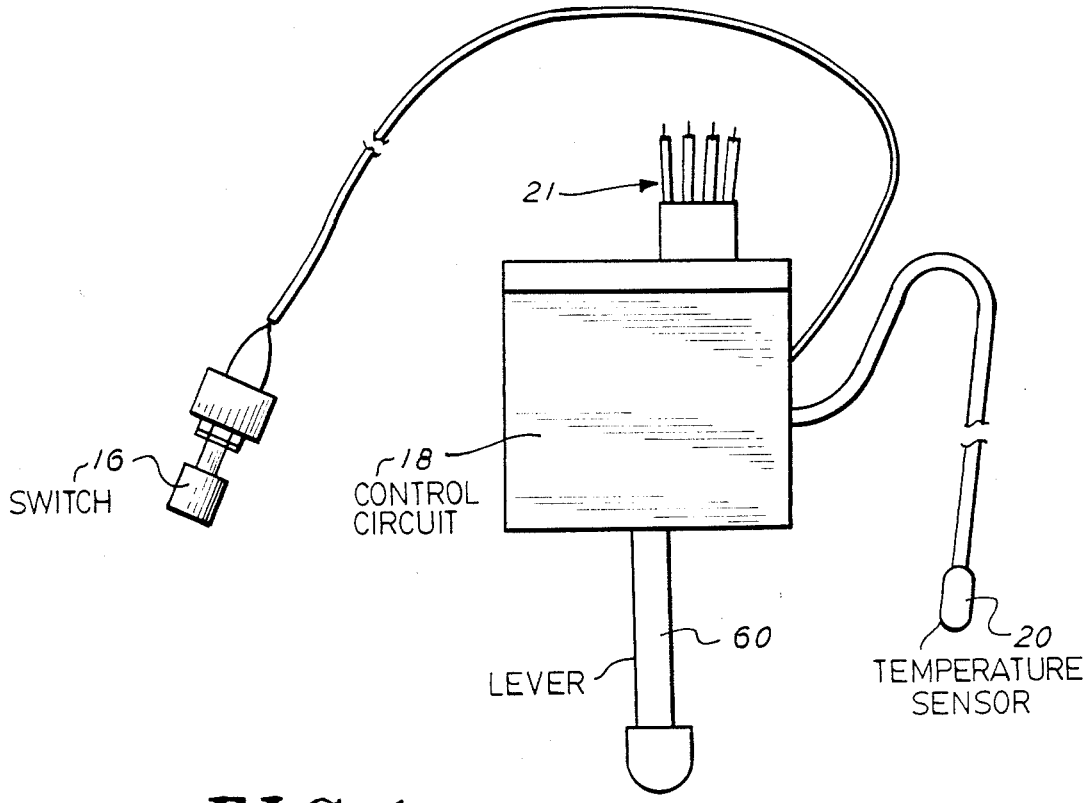
FIG. 2 is a perspective view of the manually operated "on" switch, the housing containing the control circuit and the window sensor.

FIG. 2 shows the essential parts of the window de-fogger/de-icer control system, including two methods of activating the system. A lever 60 can be installed directly on the control circuit 18 housing and this unit installed in the dashboard of the car. If it is desired to locate the control circuit remotely from the dashboard, a momentary single pole single throw normally open switch 16 may be mounted within reach of the driver and the control circuit mounted remotely. The remaining parts of the system are the sensor 20 and the connections 21 from the control unit to the battery, ignition switch, heater grid and ground.

Figures 3, 3A:
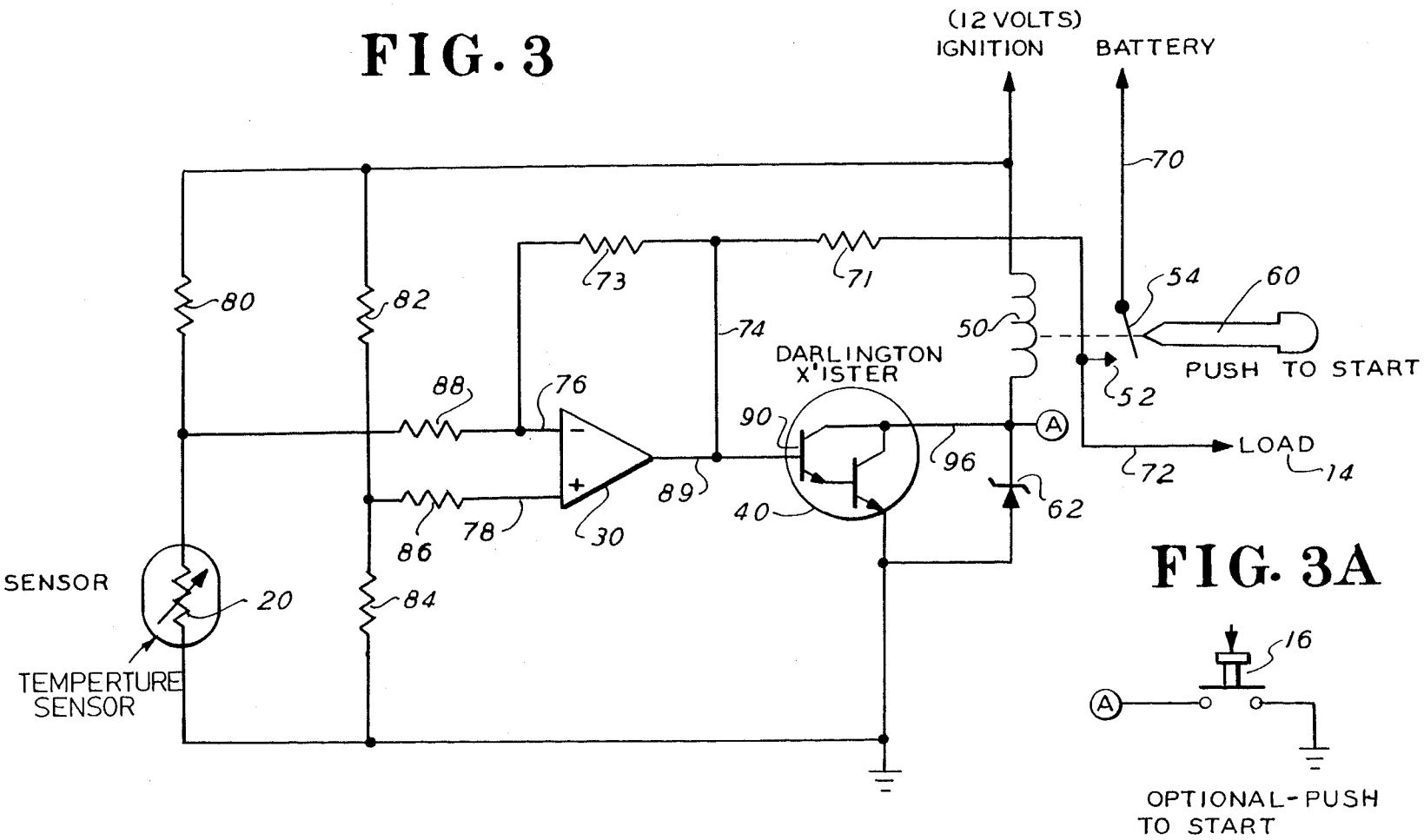
FIG. 3 shows schematically the control circuit, including the voltage divider and drive transistor of one form of the control circuit for regulating the flow of current to the window heating grid.
FIG. 3A is a sketch showing a modification of the switch.

FIG. 3 is an electrical circuit diagram of the de-fogger/de-icer system. This circuit is composed of four basic element:

A. The temperature sensor 20 which must be incorporated in or in intimate contact with the glass of the window to be de-fogger and de-iced.

B. An operational amplifier 30 which acts as a detector responding to the sensor.

C. A drive transistor 40 controlled by the output of the operational amplifier and which controls:

D. A power relay 50, whose contacts 52, 54 carry the high amperage current necessary to energize the resistance grid in or on the window and raise the temperature of the window glass to a predetermined temperature which will vaporize the condensed moisture and melt the ice or snow thereon. The sequence of operation of this system is as follows:

The operator of the vehicle will turn on the system manually operating switch 16 or 60 on the dashboard when it is desired to clear the window of condensed moisture or ice or snow.

When the dashboard mounted control circuit is used, the lever 60 manually closes the relay contacts 52, 54 connecting the battery lead 70 to the load lead 72 allowing current to flow from the battery through the relay contacts and load (resistance grid to ground).

At the same time the electric potential goes positive at contact 52 and current flows through resistors 71 & 73 & 88 and sensor 20 to ground turning the transistor 40 "ON" allowing electric current to flow from the ignition switch through the coil of the relay 50 and lead 76 through the transistor to ground. The current through the relay coil 50 holds the contacts 52 & 54 closed connecting the load to the battery.

When the remotely located control circuit is used, closing switch 16 (see FIG. 3A) allows electric current to flow through the relay coil 50 energizing the relay causing the relay contacts 52 & 54 to close. This activates the control circuit as described above.

An operational amplifier 30 is arranged in a balanced condition in a voltage divider network on each of its two inputs 76, 78. The voltage divider for each input is connected to the ignition switch (12 volts). In series with numeral 82 resistor is a fixed resistor 84 connected to ground. This fixed resistor 84 controls the voltage developed at the junction of resistors 82, 84. A resistor 86 connected between junction resistors 82, 84 and the plus input 78 to the operational amplifier 30 serves as a current limiting input of the amplifier.

The voltage divider control resistor 84 connected to the positive input of the operational amplifier 30 is of fixed value, a value selected to establish the voltage (and consequently the temperature) which must be "matched" by the other voltage divider consisting of resistor 80 and control resistor 20 in order to achieve a balance. The voltage divider control resistor 20 is not of fixed value, like the other resistors, but rather is composed of a short section (for example 2–6 inches) of a special high temperature coefficient resistance wire. This resistor (herein denoted a "sensor"), 20 is directly mounted on or embedded in the glass of the window to be de-fogged or de-iced, in thermal contact therewith so that it is always maintained at substantially the same temperature as the temperature of the window glass. When the temperature of the resistance wire 20 increases appreciably, its electrical resistance increases appreciably. When its temperature decreases appreciably, its electrical resistance decreases appreciably. Thus, it acts in effect like a sensor, changing its resistance and therefore the voltage drops across it as a function of change in the temperature of the glass window with which it is in thermal contact. A resistor 88 is connected between the junction of resistor 80 and the sensor 20 and the negative input 76 of the operation amplifier 30 as a current limiting input to the amplifier.

In its normal state, at ambient temperature, the window temperature sensor 20 has less resistance than its fixed resistor counterpart 84, and the operational amplifier 30 is in the "off" condition, because the voltage drop across sensor 20 is lower than the voltage drop across control resistor 84. This creates a voltage difference between leads 76, 78 to the operational amplifier such that the amplifier is maintained in an "off" condition with no flow of current to its output lead 89.

Connected to the output lead 89 of the operational amplifier is the drive transistor 40, which when its base is biased by a voltage turns on to allow current to flow through the coil of relay 50 thereby locking in, as previously stated, the relay contacts 52, 54 in their closed position in which current from the battery is fed to the window heater.

As previously explained, manual closing of switch 52, 54 connects the battery not only to the load 14 but also through current limiting resistor 71 and lead 74 to the base 90 of the drive transistor 40. This provides a current flow which, until interrupted as will later be explained, passes through the coil of relay 50 to create an electromagnetic field that holds switch 52, 54 in the closed position.

Current passing through window heater 14 raises the temperature of the glass with which it is in contact, and thus also raises the resistance of the wire 20 of high temperature coefficient, i.e. the resistance of sensor 20. When this resistance is increased to the point where it matches, or equals, the resistance of control resistor 84, a balance is achieved between the two voltage dividers, equalizing the plus and minus inputs to the operational amplifier 30 and turning its output "on". This effectively produces a shunt to the base 90 of the drive transistor 40, bringing its base bias voltage below the level necessary for the transistor to remain on. The transistor therefore reverts to its "off" condition, interrupting current flow through the coil 50 of the relay and enabling the spring bias (not shown) between contacts 52, 54 to open and cut off further flow of current through heater 14.

It will be seen that with the above described control system, a heater grid for a window to be de-fogged or de-iced will, once it is turned on, stay on until the glass of the window is heated to a preselected temperature, determined by the value of control resistor 84. The heater grid will then automatically be turned off, and will stay off until the system is again turned on by manual depression of switch lever 60.

The Zener diode 62 connected between the emitter and collector of the transistor 40 is a protective device. When the relay coil 50 is de-energized the collapse of its magnetic field generates a considerable reverse voltage which could damage the transistor 40. The Zener diode provides a low resistance path to ground by passing the transistor 40. The Zener diode 62 also protects the transistor 40 from high potential spikes in the vehicle's electrical system.

Resistor 73 is a feedback resistor across the operational amplifier to stabilize it.

As the relay coil is in series with the ignition switch, this system will turn off automatically when the ignition switch is opened.

Figure 4:
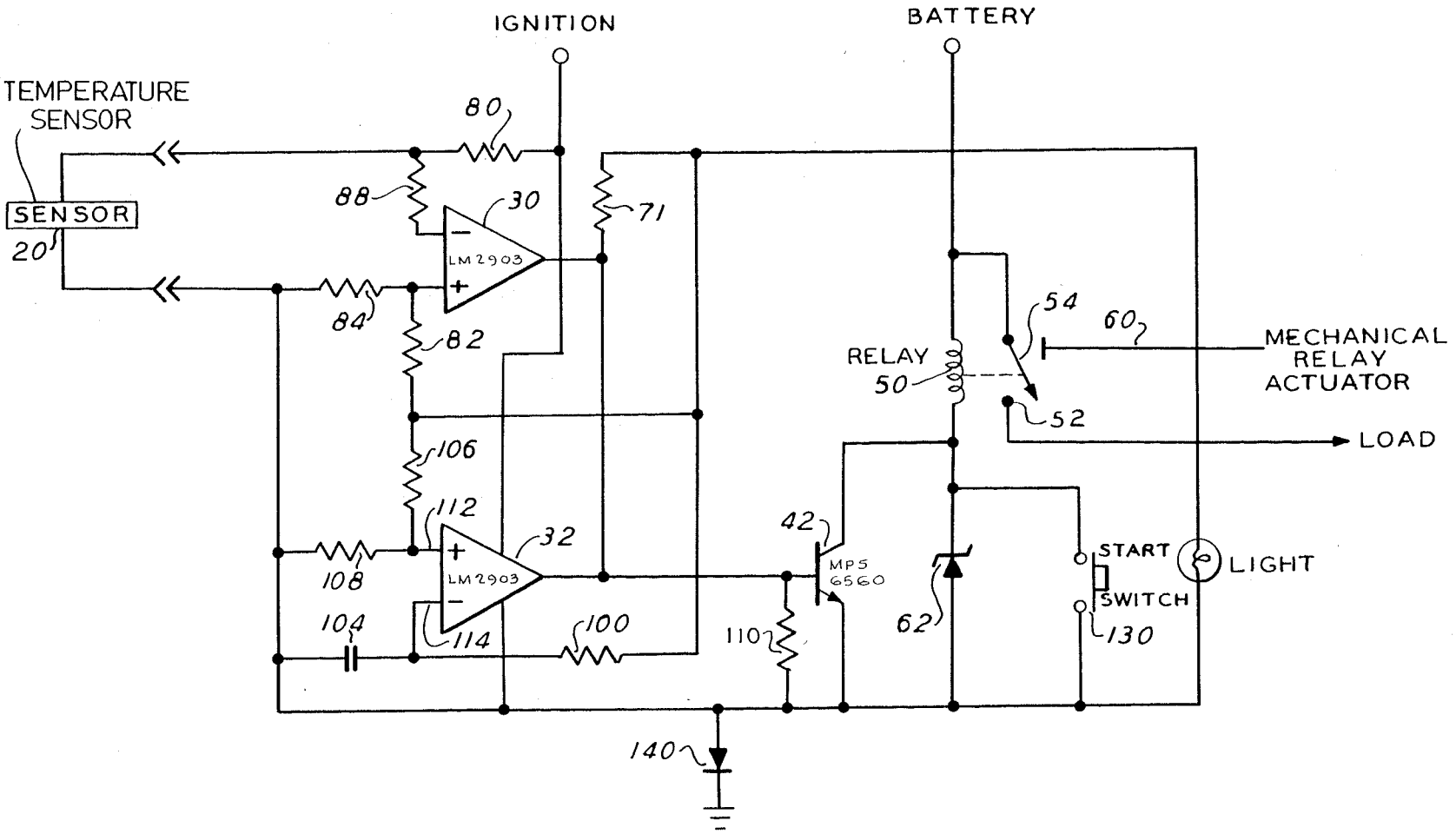
FIG. 4 shows schematically another form of the control circuit which incorporates a timer circuit setting an upper limit on the time during which the heating current may be fed to the window heating grid.

The circuit shown in FIG. 4 is operationally similar to that shown in FIG. 3 and described above with the following exceptions:

1. A second operational amplifier and a resistance-capacitance bridge have been added. This is a timing circuit which will turn "off" the electric current to the load after a specified time, whether or not the window has reached the desired temperature.
2. A single transistor is used in this circuit instead of the Darlington transistor shown in FIG. 3. The logic from the operational amplifiers to the transistor has therefore been reversed to properly operate the transistor.
3. A diode 140 has been added in the ground circuit to protect the circuit from inadvertently connecting this circuit with reverse polarity.

OPERATION

This device is turned "ON" either by the mechanical Relay Actuator 60 or the start switch 130. This applies battery voltage through the contacts 52, 54 to the voltage divider resistors 106, 108 to ground and across the resistance-capacitance bridge, resistor 100 and capacitor 104 to ground. The midpoints of these two networks are connected to the inputs 112, 114 of the operational amplifier 32. When the electrical potential at the +input 112 of the operation amplifier 32 is higher than the electrical potential at the − input 114 of the operational amplifier 32 the transistor 42 will conduct keeping the relay coil 50 energized and contacts 52, 54 closed supplying power to the load (resistance grid).

As soon as voltage is applied across the resistance capacitance bridge 100, 104 the voltage at the center point will increase at a rate determined by the values of the resistor 100 and capacitor 104 and the voltage of the battery. When the electric potential at this center joint and input 114 of the operational amplifier equals the voltage at the +input 112 of the operational amplifier 32, the operational amplifier 32 will change state and will turn "OFF" the transistor 42 stopping the current flow through the relay coil 50 and opening the relay contacts 52, 54, de-energizing the load.

I claim:

1. In combination with an automobile window having a heating grid for vaporizing fog and melting ice therefrom, the improvement which comprises an apparatus for supplying electric current to said grid, said apparatus including a manually operated mechanical switching relay for turning on the flow of current to said grid, manually operable means operated by the driver of the automobile for closing said switching relay to cause current to begin flowing through said grid when the driver feels that an unacceptable amount of fog or ice has accummulated on the automobile window, a holding circuit for said switching relay energized by said current flow for maintaining said switching relay in closed position once it is closed by said driver, a sensor comprising an electrical resistance in heat exchange relationship with the surface of said window from which the fog or ice is to be removed and whose resistance changes with changes in the temperature of said surface, and a transistorized circuit responsive to a change in said resistance for reducing the said current flow through said holding circuit to the point where it no longer will maintain said switching relay in closed position, whereby the current flow through said heating grid is turned off automatically and will remain off until the driver again manually operates said mechanical switching relay.

2. Apparatus according to claim 1, in which said transistorized circuit includes a resistance and a capacitance for causing said transistorized circuit to reduce the said current through the holding circuit and cause the switching relay to open at a predetermined time following the manual closing of said switching relay, in those situations where the sensor has not previously caused the switch to open in response to an increase in the temperature of the surface of said window before expiration of said predetermined time period.

* * * * *